US005089850A

United States Patent [19]

Ogura et al.

[11] Patent Number: 5,089,850

[45] Date of Patent: Feb. 18, 1992

[54] IMAGE FORMING UNIT WITH A CHARGER WIRE AND OPTICS CLEANING MECHANISM

[75] Inventors: Mitsuru Ogura, Nara; Takeshi Yoshida; Shoichiro Yoshiura, both of Yamatokoriyama, all of Japan

[73] Assignee: Sharp Kabushiki Kaisha, Osaka, Japan

[21] Appl. No.: 453,262

[22] Filed: Dec. 21, 1989

Related U.S. Application Data

[63] Continuation of Ser. No. 274,679, Nov. 21, 1988, abandoned, which is a continuation of Ser. No. 49,440, May 14, 1987, abandoned.

[30] Foreign Application Priority Data

May 16, 1986 [JP] Japan ..... 61-74206[U]

[51] Int. Cl.[5] ..... G03G 21/00

[52] U.S. Cl. ..... 355/215; 355/221; 355/219

[58] Field of Search ..... 355/221, 215, 228, 229, 355/263, 264, 219, 220; 15/1.51, 1.5

[56] References Cited

U.S. PATENT DOCUMENTS

| | | | |
|---|---|---|---|
| 3,842,273 | 10/1974 | Van Buskirk | 250/324 |
| 3,887,809 | 6/1975 | Marx et al. | 355/3 CH X |
| 3,891,846 | 6/1975 | Ito | 250/324 |
| 3,953,772 | 4/1976 | Zimmer . | |
| 3,965,400 | 6/1976 | Tolliver . | |
| 3,978,379 | 8/1976 | Delvecchio | 355/3 CH X |
| 4,038,546 | 7/1977 | Jasinski | 250/324 |
| 4,462,682 | 7/1984 | Monma | 355/215 |
| 4,566,777 | 1/1986 | Honda et al. | 355/15 X |
| 4,788,573 | 11/1988 | Nakaoka et al. | 355/215 |
| 4,924,268 | 5/1990 | Ogura | 355/219 |
| 4,956,671 | 9/1990 | Otsuka | 355/215 |

FOREIGN PATENT DOCUMENTS

| | | | |
|---|---|---|---|
| 2424835 | 1/1975 | Fed. Rep. of Germany | 250/324 |
| 2622651 | 8/1979 | Fed. Rep. of Germany . | |
| 3330262 | 2/1984 | Fed. Rep. of Germany | 355/297 |
| 0051851 | 4/1979 | Japan | 355/221 |
| 0116938 | 9/1979 | Japan | 355/3 CH |
| 0146635 | 11/1979 | Japan | 355/3 CH |
| 0163964 | 9/1983 | Japan | 355/221 |
| 0186761 | 10/1983 | Japan | 355/3 CH |
| 0187958 | 11/1983 | Japan | 355/3 CH |
| 0024863 | 2/1984 | Japan | 355/3 CH |
| 0045467 | 3/1984 | Japan | 355/3 CH |
| 0249169 | 12/1985 | Japan | 355/3 CH |
| 0045253 | 3/1986 | Japan | 355/3 CH |
| 1-142781 | 6/1989 | Japan . | |
| 1458088 | 12/1976 | United Kingdom . | |
| 1481123 | 7/1977 | United Kingdom . | |
| 1524053 | 9/1978 | United Kingdom . | |
| 2132942 | 7/1984 | United Kingdom . | |

*Primary Examiner*—A. T. Grimley
*Assistant Examiner*—Matthew S. Smith
*Attorney, Agent, or Firm*—Birch, Stewart, Kolasch & Birch

[57] ABSTRACT

A copying machine with a charger including a charging wire for charging the surface of a photosensitive drum and a convergent optical system for forming a focused image of an original on the surface of the drum. The copying machine further includes a waste toner unit, a cleaning unit for cleaning the charging wire and optical system which consists of a first cleaning member for grasping therebetween the charging wire stretched in the charger during cleaning, and a second cleaning member kept in contact with the surface of the convergent optical system, wherein the cleaning members are supported as to be movable in a longitudinal direction of the charging wire and the convergent optical system when cleaning the charging wire and the optical system.

1 Claim, 3 Drawing Sheets

IMAGE FORMING UNIT WITH A CHARGER WIRE AND OPTICS CLEANING MECHANISM

This application is a continuation of application Ser. No. 07/274,679 filed on Nov. 21, 1988, now abandoned which is a continuation of application Ser. No. 07/049,440, filed on May 14, 1987, now abandoned.

BACKGROUND OF THE INVENTION

1. Field of the Invention

The present invention relates to a copying machine and, more particularly, to a mechanism for cleaning both a charging wire disposed in a charger to charge the surface of a photosensitive drum and a convergent optical system which forms a focused image of an original on the drum surface.

2. Description of the Prior Art

In the known electrophotographic copying machine using a photosensitive drum and toner, there is provided a developing unit for depositing the toner from a developer tank onto the drum surface and a cleaning unit for removing the remaining toner from the drum surface after transfer of the developed toner image to a copy paper. In this structure, however, the toner is prone to scatter from such units during the copying process and thereby becomes suspended throughout the space in the copying machine. Consequently, during long-term use of the copying machine, such suspended toner is deposited on the charging wire of the charger furnished to charge the drum surface and also on the surface of the convergent optical system employed to form a focused image of an original on the drum surface, hence deteriorating the charging efficiency of the charger and reducing the amount of light of an optical image obtained by the convergent optical system. For the purpose of preventing deterioration of the copy image, it has been customary heretofore to periodically clean the charging wire of the charger and the surface of the convergent optical system.

However, in the conventional copying machine, generally the charger needs to be removed therefrom for cleaning, while the convergent optical system is cleaned at the time of maintenance service executed for other components in the machine. Consequently some labor and time are required for cleaning both components which eventually impedes quick periodic maintenance service.

SUMMARY OF THE INVENTION

It is an object of the present invention to provide an improved copying machine which realizes simultaneous cleaning of both the charging wire of a charger and convergent optical system in a simplified procedure.

In a copying machine equipped with a charger for charging the surface of a photosensitive drum and a convergent optical system for forming a focused image of an original on the drum surface, the feature of the present invention resides in the provision of a cleaning unit which consists of a first cleaning members with cleaner elements for holding therebetween during cleaning a charging wire stretched under tension in the charger and a second cleaning member kept in contact with the surface of the convergent optical system, wherein the cleaning members are supported as to be movable in the longitudinal direction with respect to the charging wire and the convergent optical system.

Due to the structure mentioned above, the charging wire stretched in the charger is held between cleaner member of the first cleaning members, while the convergent optical system is retained in contact with the second cleaning member. Since the first and second cleaning members are supported as to be movable in the longitudinal direction of the charging wire and the convergent optical system, all the cleaning members are moved together to execute simultaneous cleaning of the charging wire and the convergent optical system.

Furthermore, because of the advantage that desired cleaning is executable with both the charger and the optical system anchored in the copying machine, the entire mechanism can be shaped in smaller dimensions by uniting the charger with the photosensitive drum and incorporating the cleaner units therein.

DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
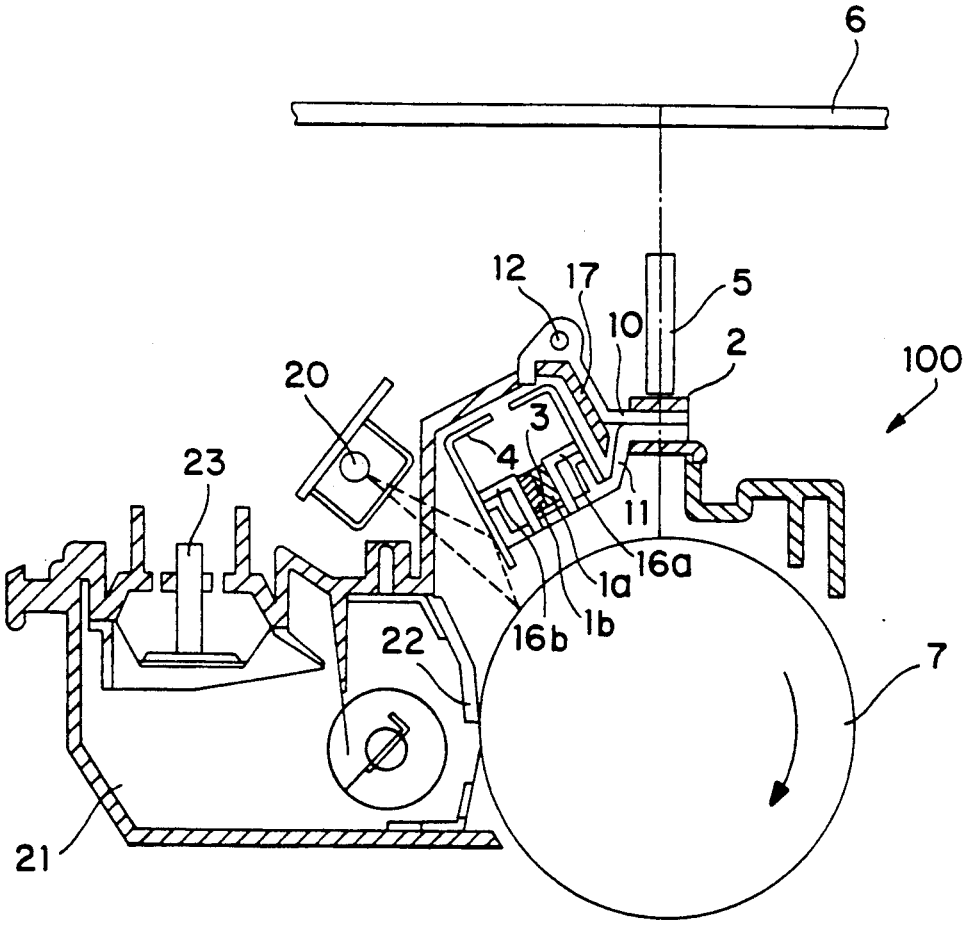
FIG. 1 illustrates the structure of a principal mechanism in an exemplary copying machine embodying the present invention.

FIG. 1 illustrates the structure of a principal mechanism in an exemplary copying machine embodying the present invention.

At the periphery of a photosensitive drum 7, there are disposed components required for a copying process. A lamp 20 serves to remove electric charge by irradiating light to the surface of the photosensitive drum 7, and a charging wire 3, stretched substantially in the center of a charger case 4, causes corona discharge upon application of a DC high voltage thereto to charge the surface of the photosensitive drum 7.

A convergent optical system 5 is disposed between an original table 6 and the photosensitive drum 7 so as to form on the drum 7 a focused image of an original placed on the table 6.

As a result, a latent image of the original is formed on the drum 7, and toner is deposited thereon by an unshown developing unit. Subsequently the toner image thus obtained is transferred to a copy paper by a transfer charger. A waste toner collector 21 scrapes and collects the remaining toner from the surface of the drum 7 by the use of a blade 22. When the toner collector 21 is fully loaded with the waste toner, a pin 23 projects to turn on or off a full-load sensing microswitch disposed above.

Cleaner elements 1*a*, 1*b* of the first cleaning member are attached to a support member 11 and are disposed in the charger case 4 during cleaning the charging wire 3 therebetween. Meanwhile, a second cleaning member 2 is attached to another support member 10 and is disposed in contact with one surface of the convergent optical system 5 opposite to the photosensitive drum. The support members 10, 11 are connected with each other by means of a guide plate 17 and are retained to be movable in the longitudinal direction (perpendicular to the drawing paper face) of the charging wire 3 and the convergent optical system 5 along the guide plate 17.

In FIG. 1, all the components except the charge removing lamp 20, convergent optical system 5 and original table 6 are integrated with one another to constitute an image forming unit 100.

Figure 2:
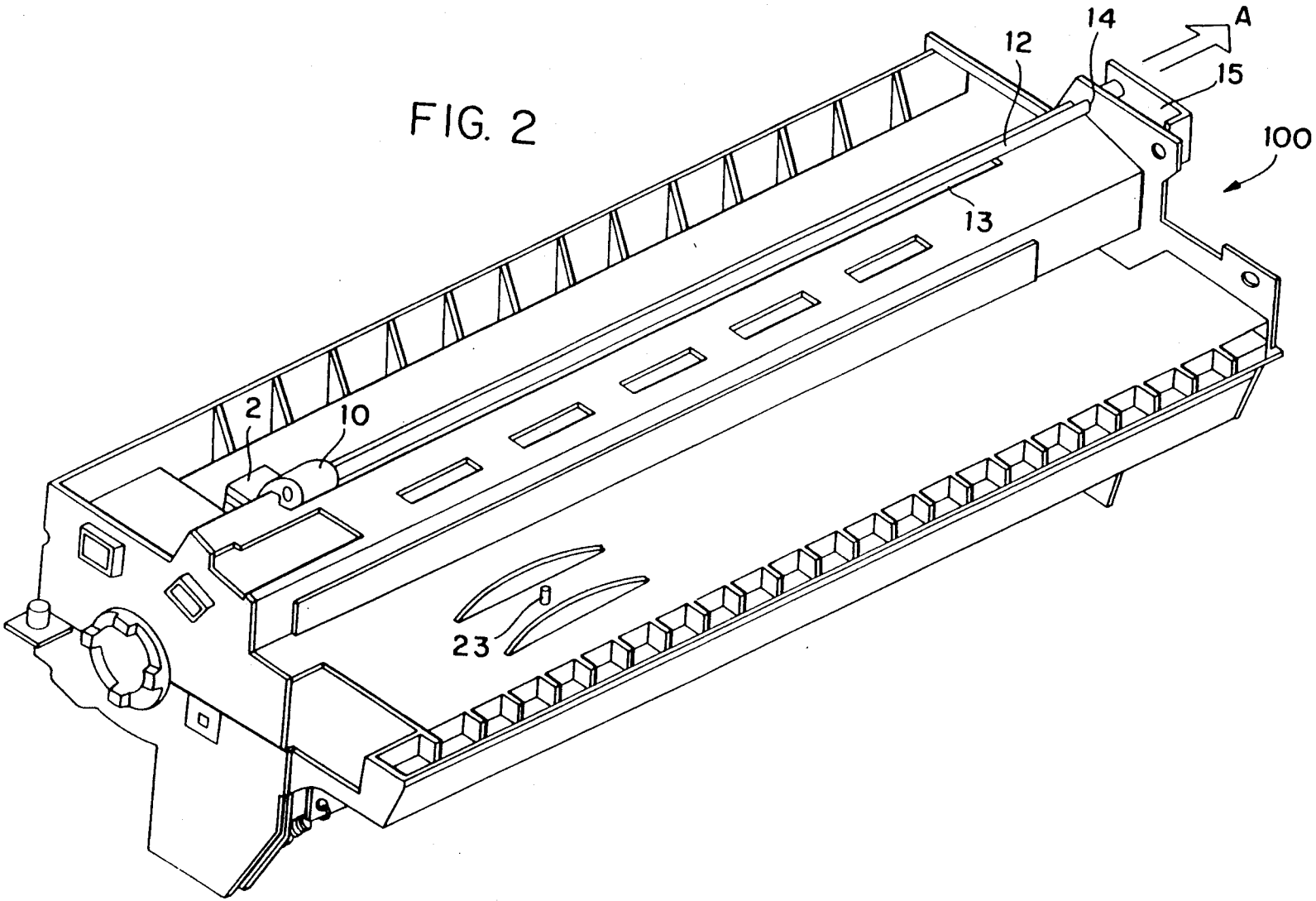
FIG. 2 is a perspective view of an image forming unit shown in FIG. 1.

FIG. 2 is a perspective view of such an image forming unit seen from above.

A connecting rod 12 extends through a hole 14 formed in a frame, and a knob 15 is attached thereto. When the support member 10 is pulled in the direction of an arrow A by the knob 15, the first and second cleaning members are moved on a straight line along an opening 13 and the guide plate 17 shown in FIG. 1, thereby cleaning the charging wire and the surface of the convergent optical system.

Figure 3:
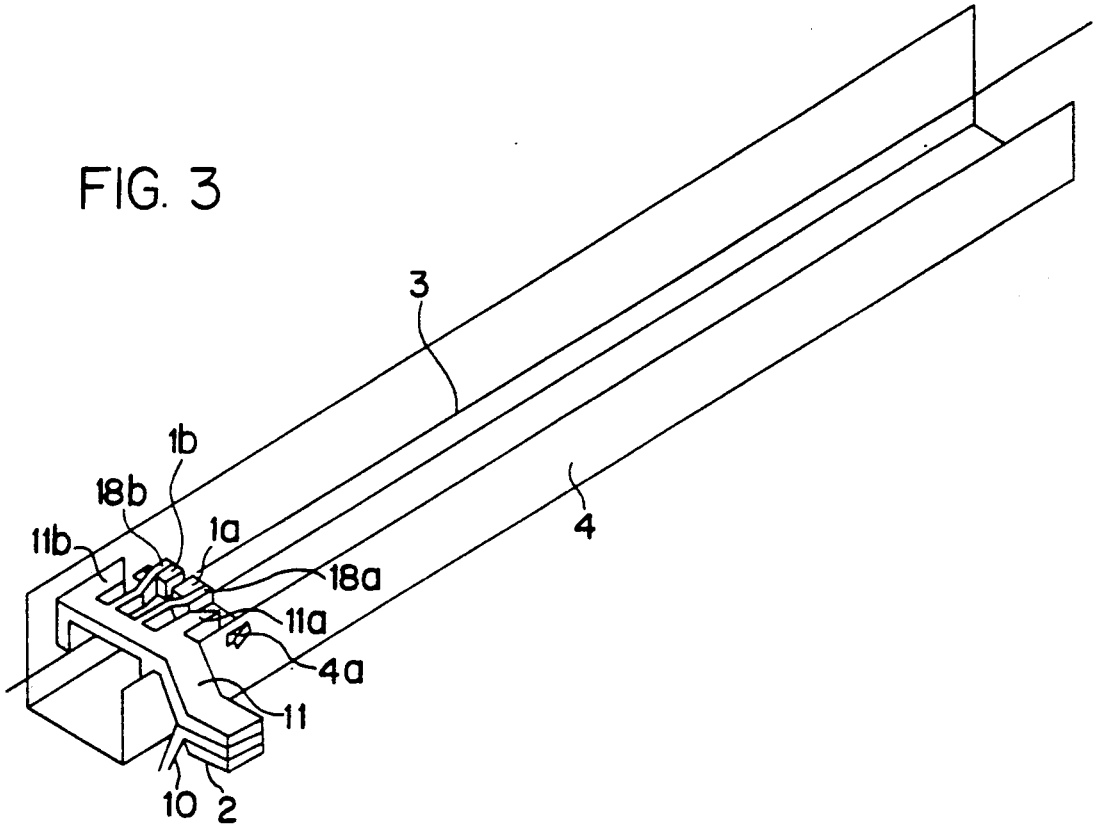
FIG. 3 is a perspective view illustrating the relationship between a charger and a first cleaning member.

FIG. 3 is a perspective view illustrating the relationship between the charger and the first cleaning member.

The support members 11*a*, 11*b* are kept in contact with inner walls of the charger case 4 in such a manner as to slide therealong in accordance with the movement of the cleaner unit. The cleaner elements 1*a*, 1*b* of the first cleaning member are attached to projections 18*a*, 18*b* of the support member 11 respectively so that, when the cleaning unit is moved, the cleaner elements 1*a*, 1*b* compressing the charging wire 3 therebetween, serve to remove the toner and so forth from the surface of the wire 3.

Figure 4A:
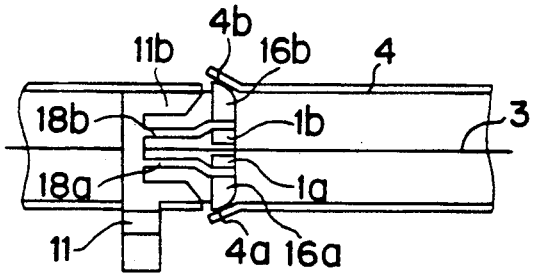
FIG. 4 (A), (B) are top views each illustrating relationship of FIG. 3.
Figure 4B:
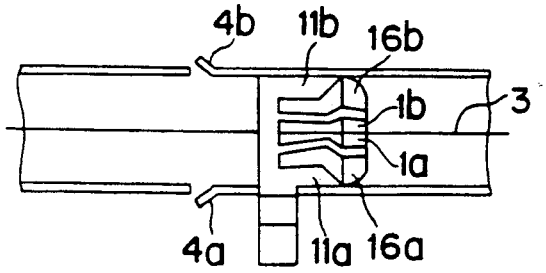

FIG. 4 (A), (B) are top views of FIG. 3 illustrating the relationship between the charger and the first cleaning member.

Two raised portions or notches 4*a*, 4*b* are formed on the two sides of the charger case 4. Meanwhile, projections 16*a*, 16*b* kept in contact with inner walls of the charger case 4 are attached to the fore ends of the projections 18*a*, 18*b* besides the cleaner elements 1*a*, 1*b*. In the state shown in FIG. 4 (A), the cleaner elements 1*a*, 1*b* are spaced apart from the charging wire 3. However, when the state of FIG. 4 (B) is caused with movement of the cleaner unit, the projections 16*a*, 16*b* are disengaged from the raised portions 4*a*, 4*b* respectively so that the outer width thereof is narrowed to be equal to the inner width of the case 4. Consequently the cleaner elements 1*a*, 1*b* come to hold or grasp the charging wire 3 therebetween. Thus, if the mechanism is so contrived that the cleaner unit is fixed at the position in FIG. 4 (A) under normal condition of use, then it becomes possible to charge the drum surface properly while keeping the cleaner elements 1*a*, 1*b* away from the charging wire 3 without affecting its corona discharge.

In this embodiment where the cleaning unit is integrated with the charger and the photosensitive drum, there is attained an advantage that no excessive force is applied from the first cleaner elements to of the first cleaning member the charging wire during the cleaning operation, hence eliminating the trouble of breakage of the wire.

While only certain embodiments of the present invention have been described, it will be apparent to those skilled in the art that various changes and modifications may be made therein without departing from the spirit and scope of the present invention as claimed.

What is claimed is:

1. An image forming unit removably attached to a copier including a photosensitive drum, a toner waste unit, a charging unit including a U-shaped charger case consisting of side walls and a bottom wall and a charging wire, for charging a surface of said photosensitive drum, stretched substantially in a center of said charger case parallel to said side walls and bottom wall, a cleaning unit for simultaneously cleaning said charging wire and a convergent optical system for said copier, said cleaning unit consisting of a first cleaning member for cleaning said charging wire in said charger case, and a second cleaning member for cleaning a surface of said convergent optical system, said first and second cleaning members being commonly supported, and means for jointly moving said first and second cleaning members together in a longitudinal direction of said charging wire and said convergent optical system along a guide plate to simultaneously clean said charging wire and said convergent optical system, said first cleaning member consisting of a pair of cleaner elements for compressing said charging wire therebetween during cleaning, each cleaner element having a lateral projection juxtapositioned to said side walls of said charger case, said projections being seated in notches formed in each of said side walls of said charger case such that said cleaner elements are spaced apart from said charging wire during charging of said surface of said photosensitive drum and which are pressured inwardly to become disengaged rom said notches during cleaning of said charging wire and said convergent optical system to slide along said side walls and grasp said charging wire therebetween, said image forming unit inclusive of said cleaning unit and waste toner unit being removable concurrently from said copier when said waste unit becomes fully loaded with waster toner.

* * * * *